US005989481A

United States Patent [19]

You

[11] Patent Number: 5,989,481

[45] Date of Patent: Nov. 23, 1999

[54] GOLF CLUB SHAFT MANUFACTURING PROCESS

[76] Inventor: Daniel H. You, 1759 Shamrock Ave., Upland, Calif. 91784

[21] Appl. No.: 08/665,568

[22] Filed: Jun. 18, 1996

[51] Int. Cl.[6] ..... B29C 45/00

[52] U.S. Cl. ..... 264/512; 264/221; 264/258; 264/317; 264/DIG. 44; 156/155; 156/173

[58] Field of Search ..... 264/130, 134, 264/161, 162, 163, 221, DIG. 44, DIG. 71, 230, 342 R, 258, 317, 512

[56] References Cited

U.S. PATENT DOCUMENTS

| | | | |
|---|---|---|---|
| 935,254 | 9/1909 | Gleason | 264/DIG. 44 |
| 2,342,556 | 2/1944 | Rockoff | 264/162 |
| 3,225,129 | 12/1965 | Taylor et al. | 264/230 |
| 3,313,541 | 4/1967 | Koczy et al. | 273/80 |
| 3,518,338 | 6/1970 | Tambussi | 264/221 |
| 3,614,101 | 10/1971 | Hunter | 273/80.2 |
| 3,896,206 | 7/1975 | Beaver et al. | 264/134 |
| 3,962,394 | 6/1976 | Hall | 264/161 |
| 4,155,970 | 5/1979 | Cassell | 264/230 |
| 4,875,956 | 10/1989 | Brackett | 264/DIG. 71 |
| 4,931,247 | 6/1990 | Yeh | 264/258 |
| 5,262,118 | 11/1993 | Fukushima et al. | 264/258 |
| 5,317,828 | 6/1994 | Yasui | 264/258 |
| 5,318,742 | 6/1994 | You | 264/258 |
| 5,458,372 | 10/1995 | Goode | 280/819 |
| 5,795,524 | 8/1998 | Basso, Jr. et al. | 264/221 |

*Primary Examiner*—Jan H. Silbaugh
*Assistant Examiner*—Stefan Staicovici
*Attorney, Agent, or Firm*—Donald W. Meeker

[57] ABSTRACT

A golf club shaft manufacturing process for making a lightweight golf club shaft that is not uniformly tapered along its length by using standard table-rolling tools and equipment. The process consists generally of creating one or more hollow sleeves and securing them around the exterior of a mandrel, the sleeves having a length and an exterior shape equal to the desired dimensions of the non-tapered portions of the shaft. Graphite flags are then rolled around the mandrel and sleeve, shrink tape is applied and the entire assembly is placed in a curing oven to cure the graphite shaft. The curing temperature is less than the melting point of either the mandrel or sleeve. Once the shaft has been cured, the shrink tape is removed and the mandrel is extracted. The remaining shaft and sleeve assembly is heated to a temperature greater than the melting point of the sleeve material so that the sleeve is liquefied and can be poured out of the shaft. The cured shaft can then be cut, sanded and finished as desired.

8 Claims, No Drawings

GOLF CLUB SHAFT MANUFACTURING PROCESS

BACKGROUND OF THE INVENTION

1. Field of the Invention

This invention relates generally to golf club shaft manufacturing procedures, and more particularly to an improved shaft manufacturing procedure that allows a golf club shaft that is not uniformly tapered to be easily manufactured with standard table-rolling equipment rather than requiring the use of expensive, specialty tools.

2. Description of Related Art

Conventional golf club shafts generally have an elongate, cylindrical shape and are uniformly tapered along the length so that the smallest diameter of the shaft is at the neck, where the club head is attached, and the largest diameter of the shaft is at the opposing, handle end where the shaft is typically gripped.

The standard method for making evenly tapered golf club shafts is commonly known as the table-rolled method. This method consists generally of laying one or more graphite flags in a bias pattern on a rolling table, and then rolling the flags around a mandrel. One or more straight-pattern flags are then hand-rolled around the mandrel. When the appropriate number of flags have been rolled around the mandrel to achieve the desired strength and torque of the shaft, shrink tape is then placed around the rolled mandrel, and the entire assembly is put in a curing oven. When the graphite has been thoroughly cured, the mandrel is extracted and the shrink wrap is removed, leaving a solid, hollow golf club shaft having an interior that conforms to the shape of the mandrel. The shaft is them cut to the appropriate length, sanded and finished as desired.

However, there is currently a trend in the golf industry to manufacture golf club shafts that are not uniformly tapered, but rather have at least one outwardly curved protrusion near the handle end of the shaft. Unfortunately, the standard table-rolled method cannot be used to create such a shaft, since the shafts manufactured in this way must continually taper in order to allow for the extraction of the mandrel.

U.S. Pat. No. 5,316,299 issued to Feche et al. discloses a shaft having such a protrusion, and French patent 91 12937 discloses a procedure for creating such a shaft. As disclosed, the process for making a non-uniformly tapered shaft requires that an air bladder be used in place of a mandrel. When inflated, the air bladder has a generally elongate, tapered shape with the desired outwardly extending protrusion. Once the air bladder has been appropriately covered with layers of graphite and cured, the air is released from the air bladder and the bladder is simply extracted from the cured golf club shaft. Both the interior and the exterior of the resulting shaft conform to the shape of the inflated air bladder. Unfortunately, as disclosed this process has many significant drawbacks and limitations. Most importantly, most golf club shaft manufacturers are equipped to manufacture shafts using mandrels and standard table-rolling procedures, and thus cannot easily incorporate the air-bladder method into their current modes of operation. In addition to the air bladder, this manufacturing process also requires specialized equipment that costs approximately $100,000 per machine.

In an attempt to avoid the expense associated with the above processes, a shaft with an outward curvature has been manufactured using traditional table-rolled techniques. In order to accomplish this, graphite flags are rolled around the mandrel as described above, and then additional layers of graphite are simply added to the exterior of the mandrel to create an outward protrusion on the shaft. This produces a shaft having an interior that is hollow in a uniformly tapered manner, and an exterior that has a protrusion. However, while this method is less expensive because standard table-rolling equipment is employed, the resulting shaft is up to 20 grams heavier than those made with an air bladder, which is a significant disadvantage in achieving maximum golf swing performance.

Thus there is a clear need for an improved golf club manufacturing process that allows a shaft that is not uniformly tapered to be easily created using traditional table-rolling equipment without increasing the weight of the resultant shaft. Such a process would reduce manufacturing costs and further reduce the weight of the shaft. The present inventive manufacturing process fulfills these needs and provides further related advantages as described in the following summary.

SUMMARY OF THE INVENTION

The present invention is a manufacturing process for creating a golf club shaft that is not uniformly tapered from the neck end to the handle end.

It is a primary object of the present inventive manufacturing process to produce a non-uniformly tapered golf club shaft that is neither significantly more expensive to manufacture than standard shafts nor heavier than standard shafts.

It is another object of the present inventive process to produce a non-uniformly tapered golf club shaft using a mandrel rather than a specially designed air bladder. This is a significant advantage of the present invention, as it allows the shaft to be manufactured using standard table-rolling equipment rather than necessitating the use of much more expensive, specialized equipment.

It is a further object of the present inventive manufacturing process to create a shaft in which both the interior and the exterior surfaces of the shaft wall have the same non-uniform shape. This ensures that the shaft wall is of the same thickness throughout, thus producing a shaft that is as lightweight as possible. This is a crucial advantage of the present inventive process, as the weight of the shaft is directly proportional to its perceived value in the market.

Other features and advantages of the present invention will become apparent from the following more detailed description, which illustrates by way of example, the principles of the invention.

DETAILED DESCRIPTION OF THE PREFERRED EMBODIMENT

The present invention is a manufacturing process for making golf club shafts that are not uniformly tapered. The process utilizes standard table-rolling golf shaft manufacturing tools and equipment.

The key inventive feature of the present inventive process is the implementation of a specially designed hollow sleeve.

The sleeve is formed of a material that has a melting point at least 20° higher than the curing temperature of the graphite shaft. Preferably, the sleeve has a generally conical shape, with an evenly tapered interior diameter corresponding to the exterior diameter of a uniformly-tapered mandrel at the paint at which it is desired to create an outward protrusion in the golf club shaft. This allows the sleeve to be simply positioned over the mandrel and slid along the length of the mandrel until the interior sleeve diameter and the exterior mandrel diameter are approximately equal to one another, at which point the sleeve is held firmly in place around the mandrel. Alternately the sleeve may be molded directly onto a mandrel. The sleeve's exterior can be formed into any desired shape, as the exterior shape of the sleeve determines the shape of the outward protrusion of the golf club shaft. Likewise, the sleeve can be formed with any desired fixed length, the length of the sleeve determining the length of the shaft protrusion. It should also be noted that more than one sleeve may be used in order to create several different protrusions on the shaft.

The present inventive golf club shaft manufacturing precess consists generally of the following steps:

1. One or more hollow sleeves as described above are created and firmly positioned around a mandrel at the desired location. Alternately, the sleeves may be formed directly around the golf shaft mandrel.

2. A release agent and liquid epoxy are preferably applied to the outer surface of the sleeves so as to provide for cleaner removal of the sleeves from the cured golf club shaft.

3. Graphite flags are rolled around the mandrel and attached sleeves in whatever manner and quantity necessary to produce a shaft of the desired strength, resilience, torque and weight.

4. The entire rolled assembly is then taped so that the graphite layers tend to compact and strengthen during the curing process. The rolled assembly may be taped with standard shrink wrap or tape, a vacuum bag, or any other such taping method known in the art.

5. The assembly is placed in a curing oven at the temperature and time required for the composition of the particular shaft. Since the mandrel and the sleeve both have melting points higher than the curing temperature, they remain intact and unchanged during the curing process.

6. Once the shaft is cured, the shrink wrap or vacuum bag is slit and removed and the mandrel is extracted from the shaft. When the mandrel is extracted, the sleeve remains in place within the interior of the hollow cured shaft.

7. The cured shaft is placed in an oven at a temperature greater than the melting point of the sleeve material so as to liquefy the sleeve while the cured shaft remains intact.

8. Once the sleeve materials have been sufficiently heated and liquefied, the shaft is removed from the oven and the liquid sleeve material is simply poured out of the shaft.

9. The interior of the shaft may be further cleaned so as to ensure that all debris is dislodged and removed from the shaft. This cleaning procedure may be accomplished by inserting a brush into the hollow shaft, by blowing air into the shaft or by a variety of other such cleaning means known in the art.

10. The shaft is then cut to the desired length, and grinded, sanded and finished as desired.

While the present inventive process has been described with reference to a preferred embodiment, it is to be clearly understood by those skilled in the art that the invention is not limited thereto. Rather, the scope of the invention is to be interpreted only in conjunction with the appended claims.

What is claimed is:

1. A method of making a graphite golf club shaft having a nonuniform tapered shape using a tapered golf club mandrel and table-rolling equipment, the method comprising:

forming a hollow sleeve from a hollow sleeve material having a melting point greater than the curing temperature of graphite, the hollow sleeve having an interior surface conforming to the shape of a tapered golf club mandrel along a portion of the tapered golf club mandrel where a protrusion is desired and the hollow sleeve having an exterior surface formed into any desired shape, the exterior surface protruding outwardly from the interior surface of the hollow sleeve to form the desired shape, the hollow sleeve forming a protrusion along the portion of the tapered golf club mandrel where a protrusion is desired, the protrusion differing in shape from the shape of the tapered golf club mandrel;

engaging the hollow sleeve around the tapered golf club mandrel by positioning the hollow sleeve over the tapered golf club mandrel and sliding the hollow sleeve along the length of the mandrel until the interior sleeve diameter and the exterior mandrel diameter are approximately equal to one another whereby the hollow sleeve is held firmly in place around the mandrel;

rolling graphite flags around the tapered golf club mandrel and the hollow sleeve covering the tapered golf club mandrel and the hollow sleeve to form a length of rolled graphite flags, the graphite flags conforming to the shape of the tapered golf club mandrel and the exterior surface of the hollow sleeve protruding from the tapered golf club mandrel;

taping the graphite flags with a shrink means to form an assembly comprising the tapered golf club mandrel, the hollow sleeve, the graphite flags and the shrink means;

curing the assembly at a desired temperature to cure the graphite flags, thereby forming the graphite flags into a graphite golf club shaft having a hollow interior, having an external configuration defined by the tapered golf club mandrel and the protruding exterior surface of the hollow sleeve, and having a uniform thickness throughout the length of the graphite golf club shaft, the desired temperature being less than the melting point of the hollow sleeve material;

removing the tapered golf club mandrel and the shrink means from the graphite golf club shaft and the hollow sleeve;

heating the graphite golf club shaft and the hollow sleeve to a temperature greater than the melting point of the hollow sleeve material to form a liquefied hollow sleeve material;

removing the liquefied hollow sleeve material from the hollow interior of the graphite golf club shaft leaving only the graphite golf club shaft; and cutting and finishing the graphite golf club shaft.

2. The method of claim 1 further comprising the step of applying a releasing agent to the interior surface and the exterior surface of the hollow sleeve prior to engaging the hollow sleeve around the tapered golf club mandrel.

3. The method of claim 2 further comprising the step of applying a liquid epoxy to the interior surface and the exterior surface of the hollow sleeve prior to engaging the hollow sleeve around the tapered golf club mandrel.

4. The method of claim 1 wherein the shrink means comprises a material selected from the group consisting of shrink tape, shrink wrap, and vacuum bags.

5. The method of claim 1 further comprising the step of forming at least one additional hollow sleeve around the tapered golf club mandrel, the at least one additional hollow sleeve having an interior surface conforming to the shape of the tapered golf club mandrel along a portion of the tapered golf club mandrel where a protrusion is desired and the at least one additional hollow sleeve having an exterior surface formed into any desired shape, the exterior surface protruding outwardly from the interior surface of the hollow sleeve to form the desired shape, the hollow sleeve forming a protrusion along the portion of the tapered golf club mandrel where a protrusion is desired, the solid protrusion differing in shape from the shape of the tapered golf club mandrel, the at least one additional hollow sleeve formed from a material having a melting point greater than the curing temperature of the graphite flags.

6. The method of claim 1 wherein the step of removing the liquefied hollow sleeve material comprises pouring the liquefied hollow sleeve material out of the shaft.

7. The method of claim 6 further comprising the step of brushing out the hollow interior of the graphite golf club shaft to remove any hollow sleeve material debris therefrom.

8. The method of claim 6 further comprising the step of blowing air into the hollow interior of the graphite golf club shaft to remove any hollow sleeve material debris therefrom.

* * * * *